United States Patent [19]

Hauer

[11] 4,196,368

[45] Apr. 1, 1980

[54] IMPROVING INCANDESCENT BULB EFFICIENCY

[75] Inventor: Charles R. Hauer, Wellesley Hills, Mass.

[73] Assignee: Eikonix Corporation, Burlington, Mass.

[21] Appl. No.: 831,172

[22] Filed: Sep. 7, 1977

[51] Int. Cl.[2] ..... H01J 1/14; H01J 19/06; H01K 1/04

[52] U.S. Cl. ..... 313/345; 313/315; 313/344

[58] Field of Search ..... 313/344, 345, 315, 222

[56] References Cited

U.S. PATENT DOCUMENTS

| | | | |
|---|---|---|---|
| 2,170,683 | 8/1939 | Friederich et al. | 313/345 X |
| 2,450,007 | 9/1948 | Litton | 313/345 |
| 3,969,131 | 7/1976 | Fatzer et al. | 313/345 |
| 3,973,155 | 8/1976 | Warren et al. | 313/345 |
| 4,016,446 | 5/1977 | Cadoff | 313/345 |
| 4,160,929 | 7/1979 | Thorington et al. | 313/112 |

*Primary Examiner*—Saxfield Chatmon, Jr.
*Attorney, Agent, or Firm*—Charles Hieken

[57] ABSTRACT

Incandescent light bulb efficiency is improved by: (1) modifying the surface micro-structure of a lamp filament in such a way as to increase the emissivity in the visible region of the spectrum without significantly increasing this quantity outside this spectral region, or suppressing the emission of energy outside the visible portion of the spectrum by modifying the surface structure; (2) application of refractory coatings on the lamp filament that are highly emissive in the visible region of the spectrum; and (3) coating the filament with an "optically thin" refractory material to suppress filament evaporation, permitting higher operating temperature.

11 Claims, 5 Drawing Figures

IMPROVING INCANDESCENT BULB EFFICIENCY

BACKGROUND OF THE INVENTION

The present invention relates in general to improving incandescent bulb efficiency and more particularly concerns novel apparatus and techniques for effecting this improvement with structure and techniques relatively inexpensive and practical to implement. The invention improves luminous output of incandescent lamps without also increasing the emission of radiant energy in the infrared region of the spectrum, luminous output being regarded as that portion of the spectrum substantially between 400 and 700 nanometers.

Incandescent light bulbs represent the main source of domestic lighting. Improved incandescent performance could result in significant energy savings. The following analysis serves as background for better understanding the principles of the invention.

The distribution of power as a function of wavelength λ radiated per unit area from a diffuse, planar surface held at absolute temperature T is governed by the relation $$W(\lambda, T)=\epsilon(\lambda, T)\, W_o(\lambda, T).$$

Here $\epsilon(\lambda,T)$ is the emissivity of the surface and $$W_o(\lambda, T) = \frac{2c^2h/\lambda^5}{e^{ch/\lambda kT} - 1},$$

with c being the velocity of light in vacuum, h Planck's constant and k Boltzmann's constant.

According to Kirchoff's law the emissivity $\epsilon$ is equal to the absorptivity of the surface and, thus, can never exceed unity. A perfect absorber, for which $\epsilon$ equals unity for all wavelengths, is called a blackbody and its distribution of power as a function of wavelength is given by $W_o(\lambda, T)$ which is called Planck's law. Plots of $W_o(\lambda, T)$ for various values of T are in the literature.

Although the distribution of power $W(\lambda, T)$ can never exceed the blackbody distribution $W_o(\lambda, T)$ it does follow that optimum performance in an incandescent light source is obtained when the source's emissivity is unity for all wavelengths. Indeed, the ultimate user of incandescent lighting is the human being, and the human visual system is not sensitive to all wavelengths of radiation. Thus, much of the power radiated by a blackbody lies outside the visible region of the spectrum and simply is of no use for lighting purposes.

The usual sensitivity of a "standard observer" is described by a spectral visual sensitivity curve $V(\lambda)$ well-known in the art having a peak at the wavelength corresponding to green. This curve allows one to convert from radiometric units, which describe radiation in terms of energy, to photometric units, which describe radiation in terms of its ability to be seen by a "standard observer". In particular, the luminous emittance $L(\lambda,T)$ of a diffuse, planar radiator is defined to be the distribution of radiated power that would be detected by a standard observer. It is given by $$L(\lambda, T)=V(\lambda)W(\lambda, T)=V(\lambda)\epsilon(\lambda, T)W_o(\lambda, T).$$

The luminous efficiency $\eta(T)$ of a diffuse radiator is defined to be the total luminous flux radiated to the total power consumed. The total luminous flux radiated per unit area is equal to $$L=685\, L(\lambda, T)d\lambda=685\, V(\lambda)\epsilon(\lambda, T)W_o(\lambda, T)d\lambda,$$

where the number 685 is a scale factor which converts from units of power (watts) to units of luminous flow (Lumens). The total power consumed is $$P=\epsilon(\lambda,T)W_o(\lambda,T)d\lambda+P_o$$

where $P_o$ lumps together the losses due to heat conduction, convection, ballast, etc. The luminous efficiency $\eta(T)$ is thus $$\eta(T) = \frac{L}{P} = 685\,\frac{V(\lambda)\epsilon(\lambda,T)W_o(\lambda,T)d\lambda}{\epsilon(\lambda,T)W_o(\lambda,T)d\lambda + P_o},$$

and carries the units of lumens per Watt.

For additional background material reference is made to the following publications:

1. M. Garbuny, *Optical Physics* (Academic Press, New York, 1965).
2. J. J. Cuomo, J. F. Ziegler and J. M. Woodall, "A New Concept for Solar Energy Thermal Conversion", IBM Research Memo-RC 4974 (1974).
3. J. J. Cuomo, J. M. Woodall and T. H. DiStefano, "Dendritic Tungsten for Solar Thermal Conversion", paper presented at the American Electroplaters Society, Nov. 1976.
4. E. Kauer, Philips Tech. Rev. 26, P. 33 (1965).
5. *U.S. Energy Flows* (U.S. Dept. of Commerce, 1973).
6. R. W. Keyes, Science 196, p. 945 (1977).
7. D. Maystre and R. Petit, Optics Comm. 17, p. 196 (1976).
8. D. Maystre and R. C. McPhedrau, Optics Comm. 12, p. 164 (1974).
9. M. Neviere, P. Vincent and R. Petit, Optics Comm. 21, p. 369 (1977).
10. M. Neviere, P. Vincent and R. Petit, Nouv. Rev. Optique 5, p. 65, (1974).

An average 100-watt incandescent bulb is rated by the manufacturer at 17 lumens per watt. The major reason for this low luminous efficiency is that a rather large percentage (approximately 72%) of the input power is radiated in the infrared which, of course, lies outside the spectral sensitivity curve $V(\lambda)$ and, thus, does not represent usable radiation as far as human vision is concerned. One prior art approach for increasing efficiency that is relatively costly involves coating the envelope with a thin film that reflects IR and transmits visible. The following table indicates the progresses of incandescent lamp performance, using lamps with approximately 60-watt power input.

TABLE I

TYPICAL INCANDESCENT LAMP PERFORMANCE

| | luminous efficiency in Lumens/watt | Approx. Life (hrs.) |
|---|---|---|
| Edison's early carbon lamp | 1.8 | 600 |
| Treated carbon lamp | 3.2 | 600 |
| Gem lamp | 4.0 | 600 |
| Nernst glower | 5.0 | 600 |
| Tantalum lamp | 4.9 | 600 |
| Osmium lamp | 4.9 | 600 |
| Tungsten lamp (1907) | 7.8 | 1000 |
| Tungsten lamp (1950) | 13.9 | 1000 |

Accordingly, it is an important object of this invention to improve the efficiency of incandescent lamps.

It is a further object of the invention to achieve the preceding object in a manner compatible with the existing incandescent light bulb manufacturing system at relatively slight additional cost.

It is still a further object of the invention to achieve one or more of the preceding objects with practical structure.

A more specific object of this invention is to improve the luminous efficiency of incandescent lamps by selective modification of the lamp's emissivity ($\lambda$,T). In particular, the luminous efficienty (T) is maximized by:

1. Maximizing $\epsilon(\lambda,T)$ over the region of the spectrum where the visual sensitivity curve $V(\lambda)$ is large.

2. Minimizing $\epsilon(\lambda,T)$ over the region of the spectrum where the visual sensitivity curve $V(\lambda)$ is small.

It is an object of this invention to achieve one or both of (1) and (2) above in a manner compatible with the existing incandescent light bulb manufacturing system at slight (if any) additional cost.

SUMMARY OF THE INVENTION

According to the invention, an incandescent lamp's luminous efficiency can be improved by increasing the ratio of visible energy radiated to total energy radiated with means closely adjacent to the filament for selectively modifying the lamp's emissivity. According to one aspect of the invention, the surface micro-structure of the lamp's filament is modified to increase the emissivity in the visible region of the spectrum without significantly increasing this quantity outside this spectral region. According to a second aspect of this invention the filament carries a coating having high emissivity in the visible spectrum such as rare earth oxides and carbides, tantalum oxide, or carbide, tungsten carbide and mixtures thereof. According to another feature of the invention, an optically thin layer of suitable material on a tungsten filament suppresses evaporation and permits operation at a higher temperature while retaining characteristic filament life.

The first aspect of the invention listed above takes advantage of the reflectivity of a metalic surface having finite conductivity depending on the micro-structure of the surface. More specifically, the reflectivity for a rough metalic surface will tend to be *smaller* than that for a smooth surface for wavelengths $\lambda$ shorter than the mean period of the surface irregularities while it will remain approximately the same as that of the smooth surface for wavelengths greater than the mean period. Since the emissivity of a metalic surface is unity minus the reflectivity, it follows that the emissivity of the surface is enhanced for wavelengths shorter than the mean period of the surface irregularities and not appreciably affected for wavelengths longer than the mean period. The luminous efficiency of an incandescent lamp can thus be optimized by properly selecting the mean period of the surface structure, such structure to include variation of conducting or dielectric properties.

The first aspect of the invention also advantageously employs the known fact that black body radiation can be approached with sufficient surface roughness and that a type of blackbody action is obtained by virtue of a porous or rough structure.

Numerous other features, objects and advantages of the invention will become apparent from the following specification when read in connection with the accompanying drawing in which:

DETAILED DESCRIPTION OF PREFERRED EMBODIMENTS

Figure 1:
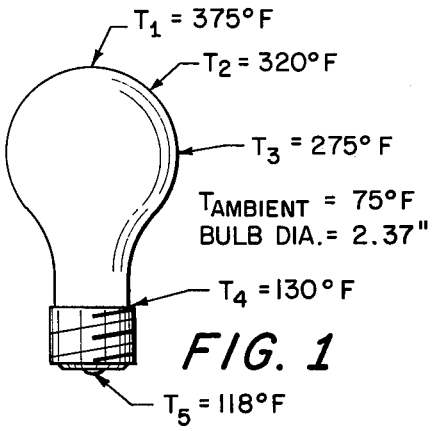
FIG. 1 is an outline of a conventional incandescent light bulb with typical temperatures at various points indicated for a 100 watt bulb.

With reference now to the drawing and more particularly FIG. 1 thereof, there is shown an outline of a conventional incandescent light bulb with typical temperatures $T_1$–$T_5$ designated for various points on the glass surface for a 100 watt bulb.

Figure 2:
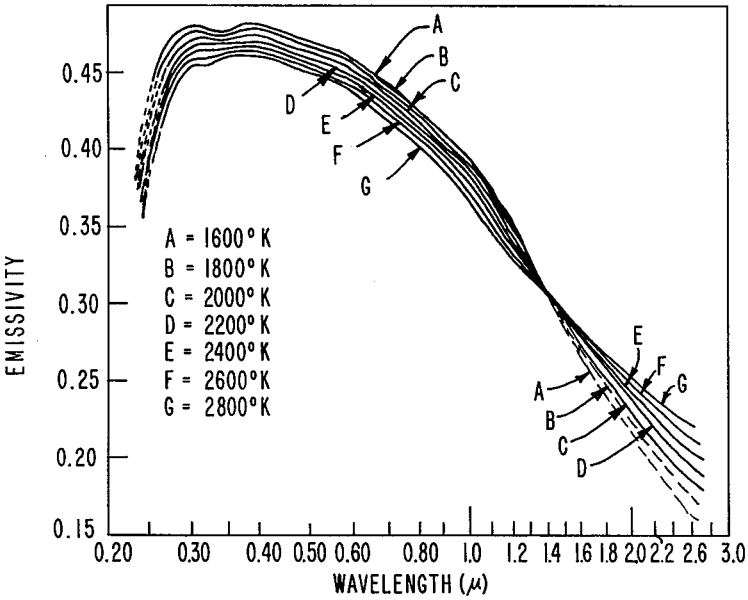
FIG. 2 is a graphical representation of the emissivity of tungsten ribbon as a function of wavelength for a number of temperatures.

Referring to FIG. 2, there is shown a graphical representation of the emissivity of tungsten ribbon over a range of temperatures as a function of wavelength. FIG. 2 shows that tungsten ribbon exhibits large variations in spectral emissivity in the visible and the infrared portions of the spectrum. This factor, in addition to its high temperature operating limit, favors the use of tungsten as an incandescent lamp filament.

Another approach to improved luminous emission for an incandescent source involves the utilization of oxide surfaces, for example $ThO_2$, NiO, $CeO_2$, $Z_rO_2$, $Y_2O_3$. A mixture of *cerium* and *thorium* oxides is used in the Auer Mantle, (gas light). The following table of emissivities at 650 nanometers for various oxides illustrates their usefulness, as emitters:

TABLE II

EMISSIVITY OF VARIOUS OXIDES AT 650 NM.

| Material | Emissivity |
|---|---|
| NiO | .89 |
| $Fe_3O4$ | .63 |
| $TiO_2$ | .52 |
| $TuO_2$ | .57 |

Because these materials melt at lower temperatures than tungsten incandescent filaments, it is preferred that they be used with other filament materials or deposited on tungsten that remains at a temperature below the oxide melting point.

A material which may be used in conjunction with tungsten is tungsten carbide, melting point about 3200° K., which is hexagonal in crystal structure and black in appearance.

Figure 3:
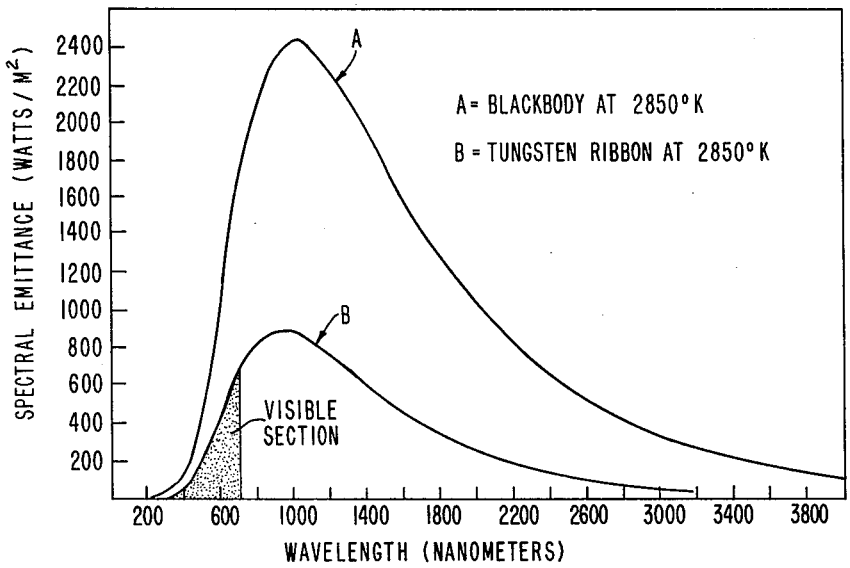
FIG. 3 is a graphical representation of the spectral emittance of a black body and tungsten as a function of wavelength at 2850° K.

Referring to FIG. 3, curve A, illustrates the output of a black body radiator at a temperature of 2850° K., while curve B illustrates the output of a tungsten filament at the same temperature. These curves show:

(a) The shift of the peak of the spectrum of the tungsten source to approximately 950 nanometers from the 1018 peak shown for the blackbody as a result of the decrease in emissivity with increasing wavelength (equivalent to a temperature increase of 200° K.).

(b) The large amount of energy emitted by the tungsten filament in the infrared portion of the spectrum in relation to the energy in the visible as a result of the modest operating temperature (2850° K.).

(c) The energy emitted from the tungsten filament is less than 45% of that of a blackbody for all wavelengths.

By selectively modifying tungsten filament surface emissivity according to the invention, more of the output energy from the filament shifts into the visible region of the spectrum. A selective radiator material is one where the emissivity of the system surface is wavelength dependent and such that radiation for the visible region of the spectrum is increased more than the emissive properties of the surface in the infrared.

The fact that emissivity and absorptivity are surface-condition-related properties of a given material rather than intrinsic properties is illustrated by platinum in its several forms. Platinum, in sheet form is a reflecting material similar to aluminum, with an emissivity of approximately 0.06 at 200° C. However when platinum in the form of "platinum black" is measured, it has an emissivity in the visible in excess of 0.9 for the same temperature. The physical difference between platinum and platinum "black" lies solely in the state of division of the material. Platinum black is platinum precipitated from solution with particle sizes ranging from 80–100 Angstroms. Conglomerates of these particles of about 1 micron in size occur as well. Thus, platinum is illustrative of a material where "surface roughness" causes large changes in absorptivity and emissivity.

The invention achieves improved efficiency incandescent lamps with one or several of the following approaches:

(a) Increased emissivity for filaments in the 400–600 nanometers range without any increase in emissivity at longer wavelengths.

(b) Decreased emissivity in the wavelength region longer than 600 nanometers.

(c) Reduced evaporation of the filament. Several specific embodiments will now be discussed.

1. Coating tungsten filaments with materials having high emissivities in the visible part of the spectrum, or forming compounds like tantalum carbide or tungsten carbide on and within the surface of the filament to increase emissivity.

2. Structuring the surface of the filament in a periodic fashion to reduce the emissivity of the surface for wavelengths greater than the period of the surface structure of the filament.

3. Coating the filament with an optically thin layer for inhibiting evaporation and allowing the operating temperature to increase while retaining filament lifetime characteristics.

Figure 4:
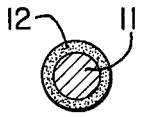
FIG. 4 is a view of a filament coated to enhance emissivity according to the invention.

Referring to FIG. 4, there is shown a sectional view through a coated tungsten filament in which tungsten filament 11 is coated with a coating 12, preferably tungsten carbide.

Preferably the material 12 has better emissivity vs. wavelength characteristics than tungsten 11 at the temperature chosen for operation. The material 12 is preferably high temperature material capable of being bonded to or sintered with tungsten filament material. An alternative approach to coating involves the formation of tungsten carbide on the surface of the filament directly, such as by using a gas phase chemical reaction.

The first step in evaluating materials is the measurement of the spectral emissivities of the chosen materials, over a temperature range from 2000° K. to 2700° K. Preferred materials include rare earth oxides and various carbides, compatible with tungsten.

Figure 5:
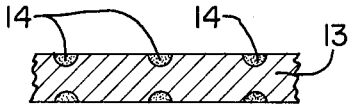
FIG. 5 is a view of a filament formed with structure according to the invention for attenuating the radiation of infrared energy.

Referring to FIG. 5, there is shown a fragmented sectional view through a tungsten filament 13 formed with periodic structure 14. This structuring of the filament in a regular manner with a period of 1000 nanometers or less functions as a means for attenuating infrared radiation.

This concept is based on the principle that periodically structured surface, like a transmission grating of a given size limits the transmission of radiation of wavelengths greater than structure period.

Physically, this may be accomplished using electron beam machining techniques on the filament ribbon itself or ruling a "mold" for sintering of powdered tungsten or other suitable filament material to make a filament.

There has been described novel apparatus and techniques for significantly improving efficiency in a practical structural arrangement compatible with existing manufacturing techniques. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In an incandescent light bulb having an electrically heated filament the improvement comprising, means in the region of said filament coacting with said filament for increasing the ratio of visible energy radiated through the bulb envelope to infrared energy radiated through the bulb envelope, said means comprising a coating on said filament for attenuating the radiation of infrared energy from said filament.

2. The improvement in accordance with claim 1 wherein said coating has a melting point greater than that of said filament and is optically thin of thickness less than the wavelength of visible radiant energy.

3. The improvement in accordance with claim 2 wherein said thickness is less than 400 nanometers.

4. The improvement in accordance with claim 2 wherein said filament is tungsten and said coating is tantalum carbide.

5. The improvement in accordance with claim 1 wherein said coating is characterized by an emissivity in the visible spectrum that is significantly greater than emissivity outside the visible spectrum.

6. The improvement in accordance with claim 1 wherein said filament is tungsten and said means comprises material having high emissivity in the visible part of the spectrum contacting said tungsten filament.

7. The improvement in accordance with claim 6 wherein said material is within the group consisting of tantalum carbide or tungsten carbide on and within the surface of the tungsten filament.

8. In an incandescent light bulb having an electrically heated filament the improvement comprising, means in the region of said filament coacting with said filament for increasing the ratio of visible energy radiated through the bulb envelope to infrared energy radiated through the bulb envelope, said means comprising means for attenuating the radiation of infrared energy from said filament, wherein said means for attenuating comprises regularly spaced pores formed in said filament having a period greater than the wavelength of visible radiant energy and less than the wavelength of infrared radiant energy.

9. The improvement in accordance with claim 4 wherein the separation between adjacent pores is less than substantially 1000 nanometers.

10. In an incandescent light bulb having an electrically heated filament the improvement comprising, means in the region of said filament coacting with said filament for increasing the ratio of visible energy radiated through the bulb envelope to infrared energy radiated through the bulb envelope, wherein said means comprises periodic structure on the surface of said filament for reducing the emissivity of said surface for wavelengths greater than the period of said periodic structure which latter period is greater than the wavelength of visible radiant energy and less than the wavelength of infrared radiant energy.

11. In an incandescent light bulb having an electrically heated filament the improvement comprising, means in the region of said filament coating with said filament for increasing the ratio of visible energy radiated through the bulb envelope to infrared energy radiated through the bulb envelope, wherein said means comprises an optically thin layer on the surface of said filament for inhibiting evaporation thereof and allowing the operating temperature to increase while retaining filament lifetime characteristics.

* * * * *